US006192725B1

(12) United States Patent
Watson et al.

(10) Patent No.: US 6,192,725 B1
(45) Date of Patent: Feb. 27, 2001

(54) LIFTGATE HANDLE AND LATCH ASSEMBLY

(75) Inventors: Earl L. Watson, Walled Lake; Donald G. Mikolai, Dearborn, both of MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/451,333

(22) Filed: Nov. 30, 1999

(51) Int. Cl.[7] ..... E05B 13/00

(52) U.S. Cl. ..... 70/208; 70/237; 296/106; 292/336.3; 292/DIG. 43

(58) Field of Search ..... 70/208, 237; 296/106; 292/DIG. 23, DIG. 29, DIG. 42, DIG. 43, 201, 216, 144, 336.3

(56) References Cited

U.S. PATENT DOCUMENTS

| | | | | |
|---|---|---|---|---|
| 2,793,907 | | 5/1957 | Hess et al. | 296/106 |
| 4,155,233 | | 5/1979 | Lira | 292/DIG. 42 X |
| 4,157,844 | | 6/1979 | Sarosy et al. | 292/DIG. 43 X |
| 4,312,202 | | 1/1982 | Pastva, Jr. et al. | 70/472 |
| 4,321,812 | | 3/1982 | Pelcin | 70/472 |
| 4,898,413 | | 2/1990 | Bertolini | 292/336.3 |
| 4,969,672 | | 11/1990 | Childs et al. | 292/201 |
| 4,971,370 | * | 11/1990 | Detweiler et al. | 292/DIG. 43 X |
| 5,035,449 | | 7/1991 | Shiratori et al. | 292/DIG. 43 X |
| 5,174,619 | | 12/1992 | Bender et al. | 292/336.3 |
| 5,183,310 | | 2/1993 | Shaughnessy | 296/106 |
| 5,295,374 | | 3/1994 | Bender et al. | 70/208 |
| 5,411,302 | * | 5/1995 | Shimada | 292/DIG. 43 X |
| 5,443,292 | * | 8/1995 | Shimada et al. | 292/DIG. 43 X |
| 5,448,856 | | 9/1995 | Moore et al. | 49/340 |
| 5,451,089 | | 9/1995 | Bender | 292/DIG. 29 |
| 5,454,607 | * | 10/1995 | Ishihara et al. | 292/DIG. 43 X |
| 5,531,498 | | 7/1996 | Kowall | 296/146.4 |
| 5,642,636 | * | 7/1997 | Mitsui | 292/DIG. 43 X |
| 5,730,028 | * | 3/1998 | Maue et al. | 292/DIG. 43 X |
| 5,829,799 | * | 11/1998 | Yamagishi et al. | 292/216 X |
| 5,852,943 | | 12/1998 | Dutka et al. | 70/237 |
| 5,894,749 | * | 4/1999 | Tomaszewski et al. | 292/DIG. 43 X |
| 5,986,351 | * | 11/1999 | Sauerbrey et al. | 292/DIG. 43 X |
| 6,017,067 | * | 1/2000 | Yoneyama et al. | 292/216 |

* cited by examiner

*Primary Examiner*—Suzanne Dino Barrett
(74) *Attorney, Agent, or Firm*—Roland A. Fuller, III

(57) ABSTRACT

A liftgate handle assembly for actuating a remotely mounted liftgate latch comprising a liftgate handle assembly including a housing having a handle pivotally mounted therein, a key cylinder rotatably mounted therein, a main lever slidably and pivotally mounted thereon, a subordinate lever mounted thereon and in pivotal communication with the main lever which is operably engageable by the handle and operably connected to the key cylinder. The liftgate handle assembly includes a cable connected between the subordinate lever and the liftgate latch. The main lever is adapted to be reciprocally slidably actuated between a locked and an unlocked mode by rotation of the key cylinder, and pivotally actuated in an unlocked mode by manually lifting the handle to move the cable via the subordinate lever to operate the liftgate latch.

5 Claims, 6 Drawing Sheets

LIFTGATE HANDLE AND LATCH ASSEMBLY

TECHNICAL FIELD

This invention relates generally to handle assemblies, and more particularly to an improved liftgate handle and latch assembly.

DISCUSSION

Since the origin of the automobile the necessity existed for the inclusion of handle assemblies for the various doors, latches and liftgates that have evolved with the evolution of the automobile. Over the years, handle assemblies have improved as new and innovative assemblies have been discovered. In modern day vehicles having liftgate handle locking mechanisms and more particularly liftgate with dual latch and/or combined liftgate/liftglass locking features, the desire for multiple interrelated functions have required new and innovative methods of packaging. More particularly, in order to accommodate the multiple features such as operation of a mechanism that controls both the liftgate and liftgate locking feature for example, as well as the inclusion of a power feature to perform these functions and others, the packaging of the features in the confined space of a narrow liftgate has resulted in the necessity for narrow tolerances and build variation.

In the example of a sport utility vehicle the liftgate handle assembly is spaced from the liftgate latch mechanism such that the two are connected by a latch rod extending between a lever and a latch mechanism to actuate the latter. Due to the rigidity of the latching rod and the fixed nature of the liftgate handle assembly and latch mechanism, there is little tolerance for build variation. This results in difficulties during the installation of the assembly in production of the vehicle necessitating during production, and after, adjustments to the latch rod so that the system can operate appropriately. This results in increased costs in slowing production and in post-production adjustments.

Therefore, it is an object of the present invention to provide a handle and latch assembly that compensates for build variation.

SUMMARY OF THE INVENTION

Accordingly, it is an object of the present invention to provide a handle and latch assembly that frees up build variation.

It is a further object of the present invention to provide a handle and latch assembly that is contained in dimensional length therein allowing loading in an existing liftgate/liftgate design.

These and other objects and advantages of the invention will become more apparent when reference is made to the following drawings and accompanying description.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict an illustrated embodiment of the present invention and are not therefore to be considered limiting in scope, the invention will be described and explained with additional specificity and detail through use of the accompanying drawings in which.

DETAILED DESCRIPTION OF THE PREFERRED EMBODIMENTS

Figure 1:
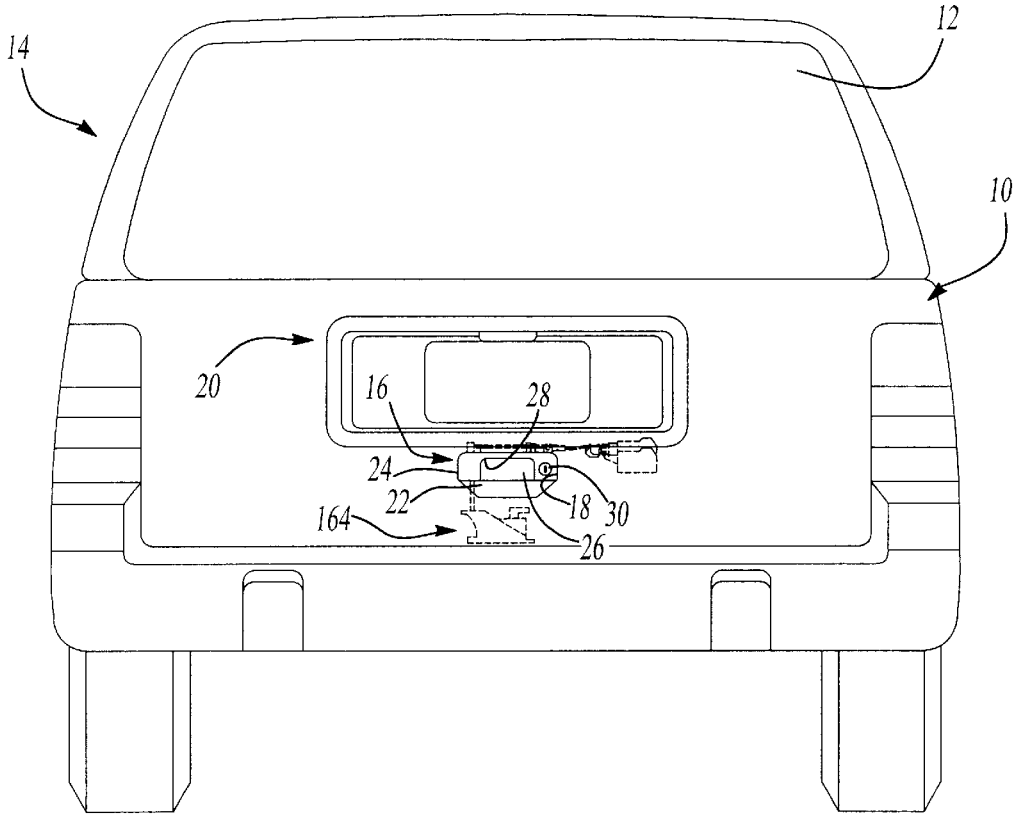
FIG. 1 is a rear view of a vehicle illustrating its liftgate, rear window, and a housing assembly embodying the invention.
Figure 3:
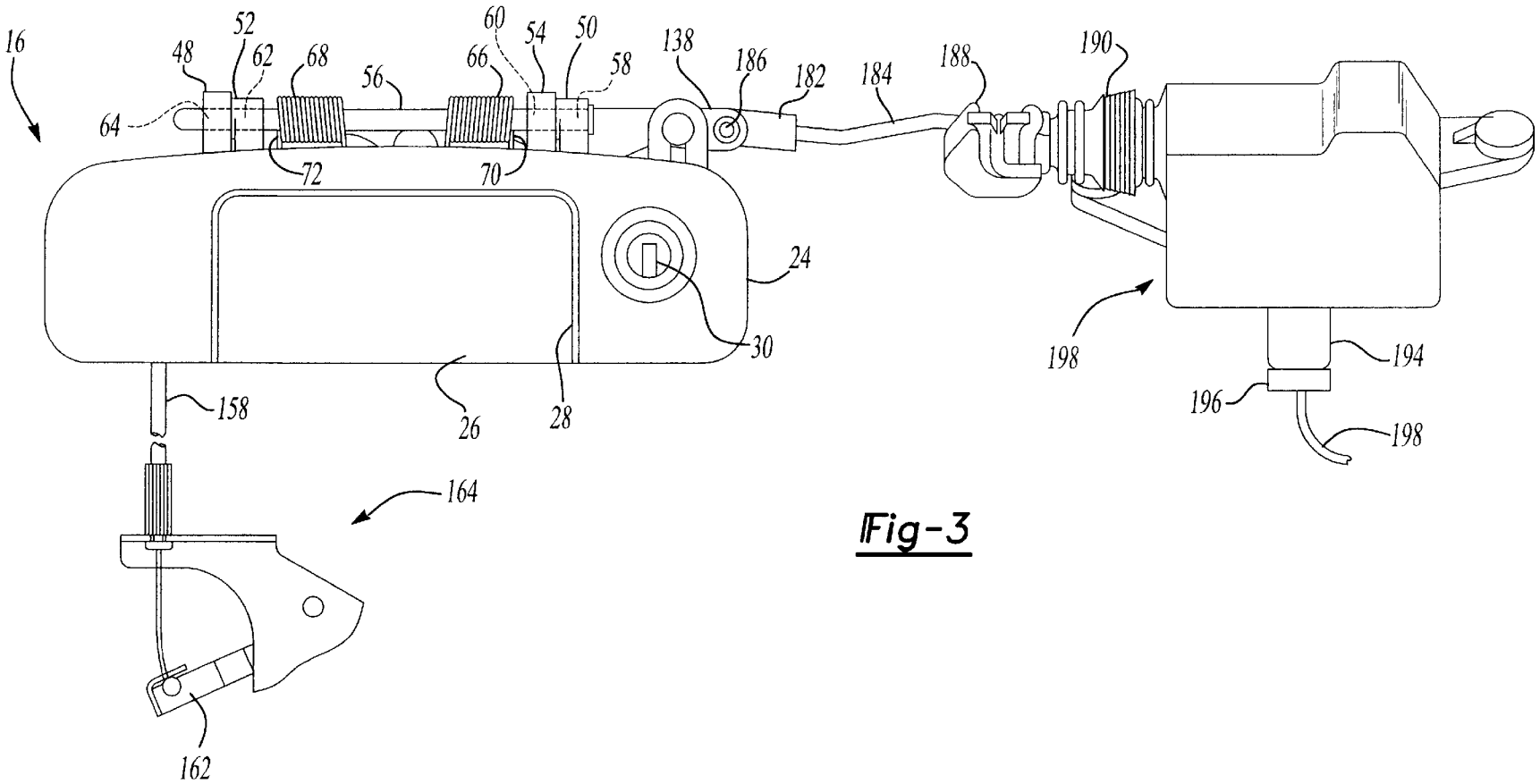
FIG. 3 is a front view of the inventive housing assembly, and remote mounted liftgate latch and power actuator therefor.

The present invention is directed to a liftgate handle and latch assembly within a liftgate, as generally illustrated in FIG. 1. Turning to the illustrated embodiment of FIG. 1, a liftgate 10 and adjacent window 12 of a vehicle 14 includes a liftgate outside handle assembly 16 mounted in an opening 18 formed in a central portion of the liftgate 10. The assembly 16 is positioned as high as possible above the lower end of the liftgate 10, away from any water and contaminants that may be lifted up from the roadway. As best shown in FIG. 3, the handle assembly 16 includes a housing 24 having a flush-type, pull-to handle 26 pivotally mounted in a central pocket 28 in the housing. A key cylinder 30 is rotatably mounted in one end of the housing 24.

Figure 7:
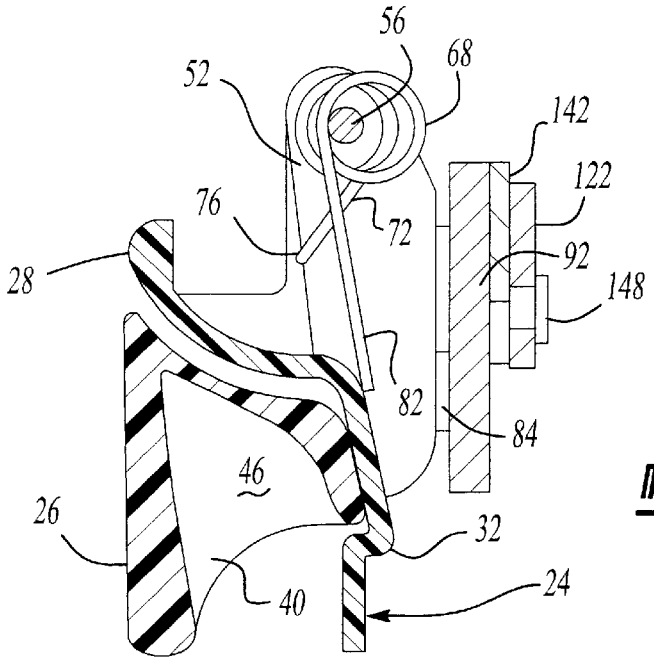
FIG. 7 is a cross-sectional view taken along line 7—7 of FIG. 5.
Figure 8:
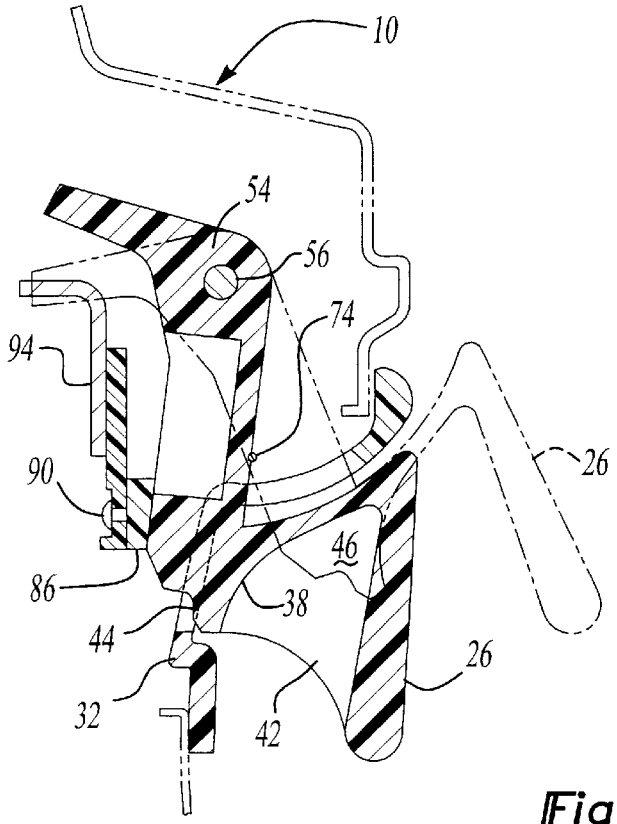
FIG. 8 is a cross-sectional view taken along line 8—8 of FIG. 5, illustrating two operational positions of a portion of the invention.

Turning to FIGS. 7 and 8 an arcuate-shaped wall 32 forms a recess portion 36 for receiving the handle 26. The handle 26 is connected to an arcuate-shaped back wall 38 by short side walls 40 and 42. The back wall 38 abuts against a recessed surface 44 formed in the wall 32. The walls 38, 40 and 42 form a pocket 46 behind the handle 26 for inserting an operator's fingers.

Two spaced-apart, upwardly extending mounting flanges 48 and 50 are formed on the back side of the housing wall 32. A pair of upwardly extending mounting arms 52 and 54 are formed on the back side of the handle wall 38, adapted to extend upwardly adjacent the inside surfaces of the respective mounting flanges 48 and 50. A pivot pin 56 extends through aligned openings 58, 60, 62, and 64 formed adjacent to the upper ends of the respective mounting members 50, 54, 52 and 48 such that the mounting arms 52 and 54 are pivotally mounted thereon to accommodate the manual lifting of the handle 26. Torsion springs 66 and 68 are mounted around the central portions of the pin 56 adjacent the mounting arms 52 and 54. End wires 70 and 72 extending from one end of the springs 66 and 68 downwardly along side the arm 52 and 54 against housing wall 32, with a bent end 74 and 76 thereof extending laterally so as to lie on the front edge 78 of the arms 52 and 54. Second end wires 80 and 82 extending from the other end of the springs 66 and 68, respectively, extend downwardly so as to engage the back side of the wall 32 forming the recess 36 in the housing 24. As such, the coil springs 66 and 68 and ends 74 and 76 and 80 and 82 serve to urge the handle 26 into its closed, flush position in the housing 24.

Figure 4:
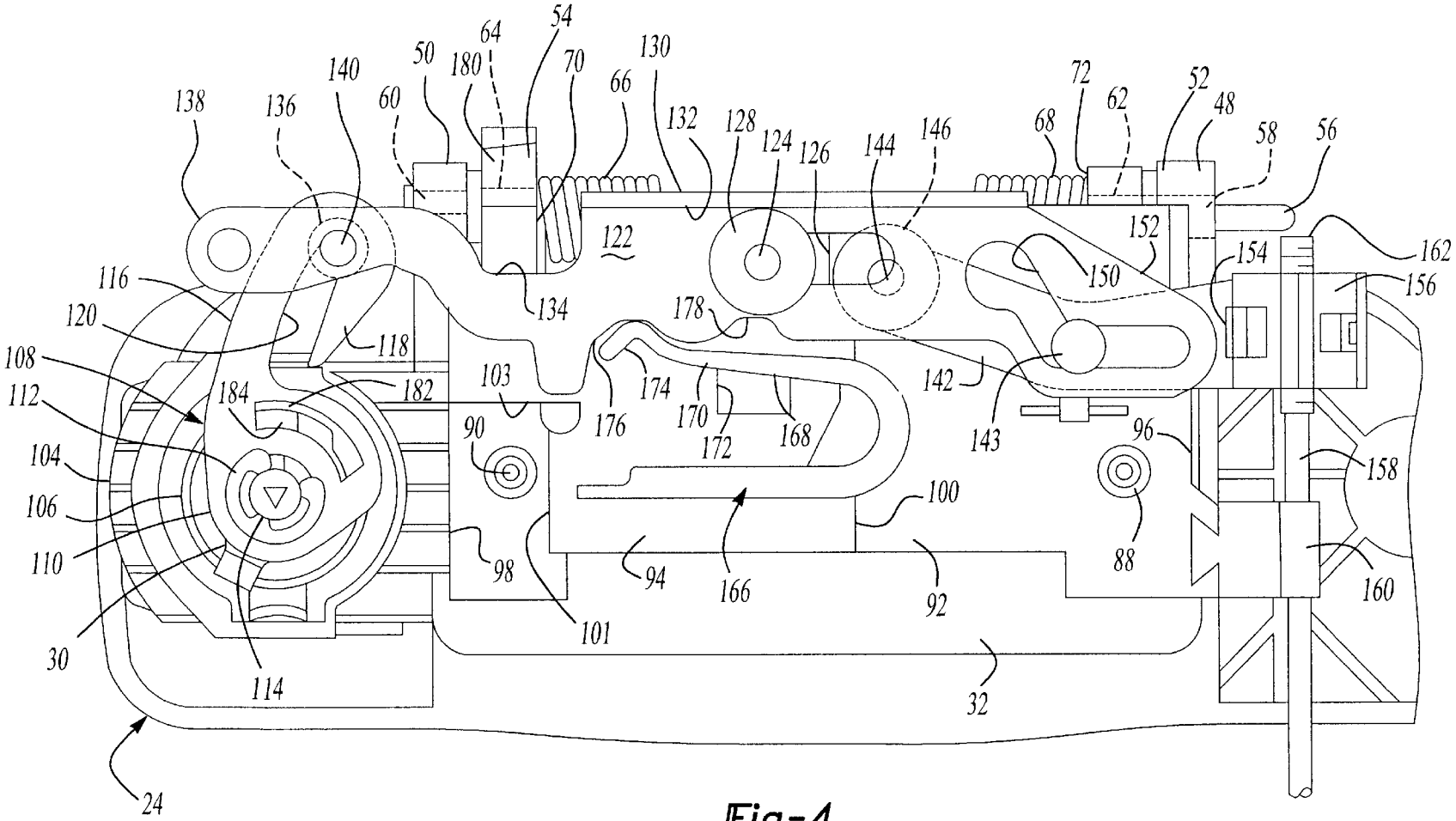
FIG. 4–6 are rear views of the housing assembly illustrating three operational conditions thereof.

As shown in FIGS. 4, 7 and 8 the upwardly extending mounting arms 52 and 54 extend along the back wall 32 of the housing. When the back wall 38 of the handle 26 is urged by the springs 66 and 68 against the recessed surface 44 of the housing wall 32, the arms 52 and 54 abut against respective rubber stops 84 and 86 (best seen in FIGS. 7 and 8) mounted in holes 88 and 90 (best seen in FIG. 4), formed in additional back walls 92 and 94 having side walls 96 and 98 molded between the housing upwardly extending mounting flanges 48 an d 50. Back walls 92 and 94 are molded such that approximately midway between the e upwardly extending mounting flanges 48 and 50, back wall 94 extends further outwardly than back wall 92 forming a side wall 100 connecting back walls 92 and 94, a and side walls 101 and 103 best shown in FIG. 4. The molded configuration of additional back walls 92 and 94 create a steeped configuration wherein additional back wall 92 is on a lower or inwardly positioned plane as compared to additional back wall 94 which is predominantly on a higher or outwardly positioned plane.

Returning to FIG. 4, it is noted that the key cylinder 30 is inserted into and rotatably mounted in an enclosure 104 molded as an integral part of the back of the housing 24 adjacent a side of the recess 36. A coil spring, represented as 106, is mounted around the cylinder 30 exterior of the enclosure 104, serving to return the cylinder to center after a key (not shown) has rotated the cylinder. A hook-like cylinder lever 108 is secured at it slower body portion 110 by a suitable fastener 112 (a C-clip is shown) to an extension 114 of the key cylinder 30. An upwardly extending arm 116 is formed on the lower end portion 110, and a downwardly extending finger 118 is formed on the arm 116, such that an open-ended slot 120 is formed between the arm 116 and the finger 118 for a purpose to be described.

Returning to FIG. 4, a main lever 122 pivotably and is laterally slidably mounted on the upper portion of the back side of the additional back wall 94. Specifically, a pin 124 is mounted through the additional back wall 94, and a first slot 126 is formed in a mid-section of the lever 122 for mounting on the pin 124. A washer 128 retains the lever 122 for mounting on the pin 124. A lip 130 is formed on a top edge 132 of the lever 122. A notch 1 34 is formed in the top edge 132 adjacent the lip 130. A hole 1 36 is formed at a first end 138 of the lever 122. A pin 140 is mounted and secured to lever 122 through the hole 136. The pin 140 extends through the open-ended slot 120 of the key cylinder lever 108 at the juncture of the arm 116 and finger 118. The pin 140 is adapted to be secured within the slot 120. The pin is a pivoting, slidable connector between levers 122 and 108.

Figure 2:
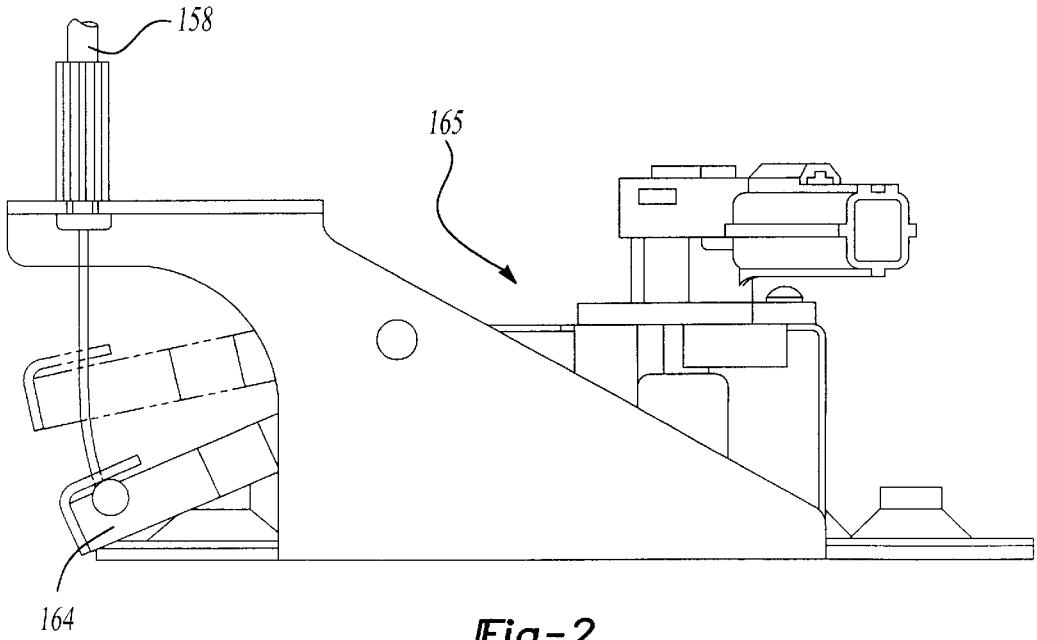
FIG. 2 is a front view of a latch mechanism illustrating two operational positions thereof.

A subordinate lever 142 is movably mounted on the upper portion of the back side of the additional back wall 92 in a position between the back wall 92 and the main lever 122 and in communication with the main lever 122. Specifically, a pin 144 is mounted through the additional back wall 92. The pin 144 pivotally mounts one end of the subordinate lever 142 to the additional back wall 92 via a washer 146. The subordinate lever 142 has along its midsection a headed shoulder pin protrusion 148. The protrusion 148 is designed to movably engage a slot 150 that is formed at a second end 152 of main lever 122. The subordinate lever 142 also has at its end 154 a connector clip 156. A cable sheathing 158 is secured to a connector clip 160 mounted to the housing 24 and a cable end fitting 162 is movably connected to the connector clip 156 on the end 154 of the subordinate lever 142. The cable 158 extends downwardly so as to operatively engage a latch lever 164 (FIGS. 1–3) extending from a latch mechanism 165 in FIG. 2, located adjacent the bottom edge of the liftgate 10.

Figure 6:
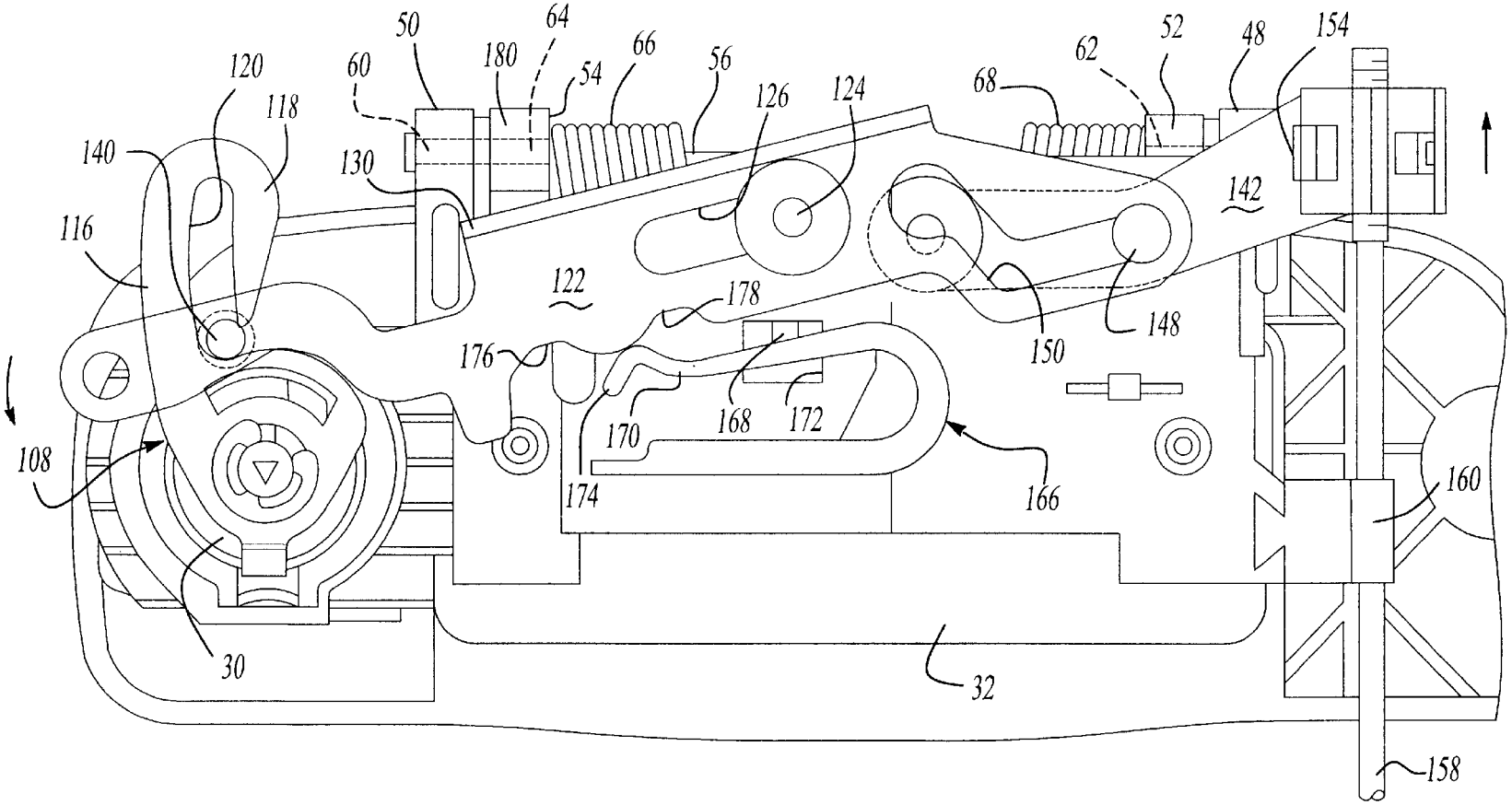

Referring once again to FIG. 4, it is noted that a U-shaped leaf spring 166 is mounted on the bottom portion of the additional back wall 94, below the lever 122. An upwardly turned tab 168 (best shown in FIG. 6) formed at an intermediate portion of the upper leg 170 of the leaf spring 166 extends through a square opening 172 in the additional back wall 94. The upper edge of the opening 172 serves as a stop for the tab 168 and the associated upper leg 170. A convex bend 174 if formed on the distal end of the upper leg 170 for cooperation with each of two spaced recessed portions 176 and 178 formed on the bottom edge of the lever 122.

Returning to FIG. 4, an actuator lug 180 is formed on the upper end of the mounting arm 54, extending across the space above a notch 134 in the top edge 132 of the lever 122, when the latter is in its rightmost or locked mode position. If the handle 26 were pulled or pivoted outwardly from the housing 24 while the lever 122 is in this locked mode position, the actuator lug 180 merely moves through the space above the notch 134, without moving the lever 122, and, therefore, without unlatching the latch 164.

Figure 5:
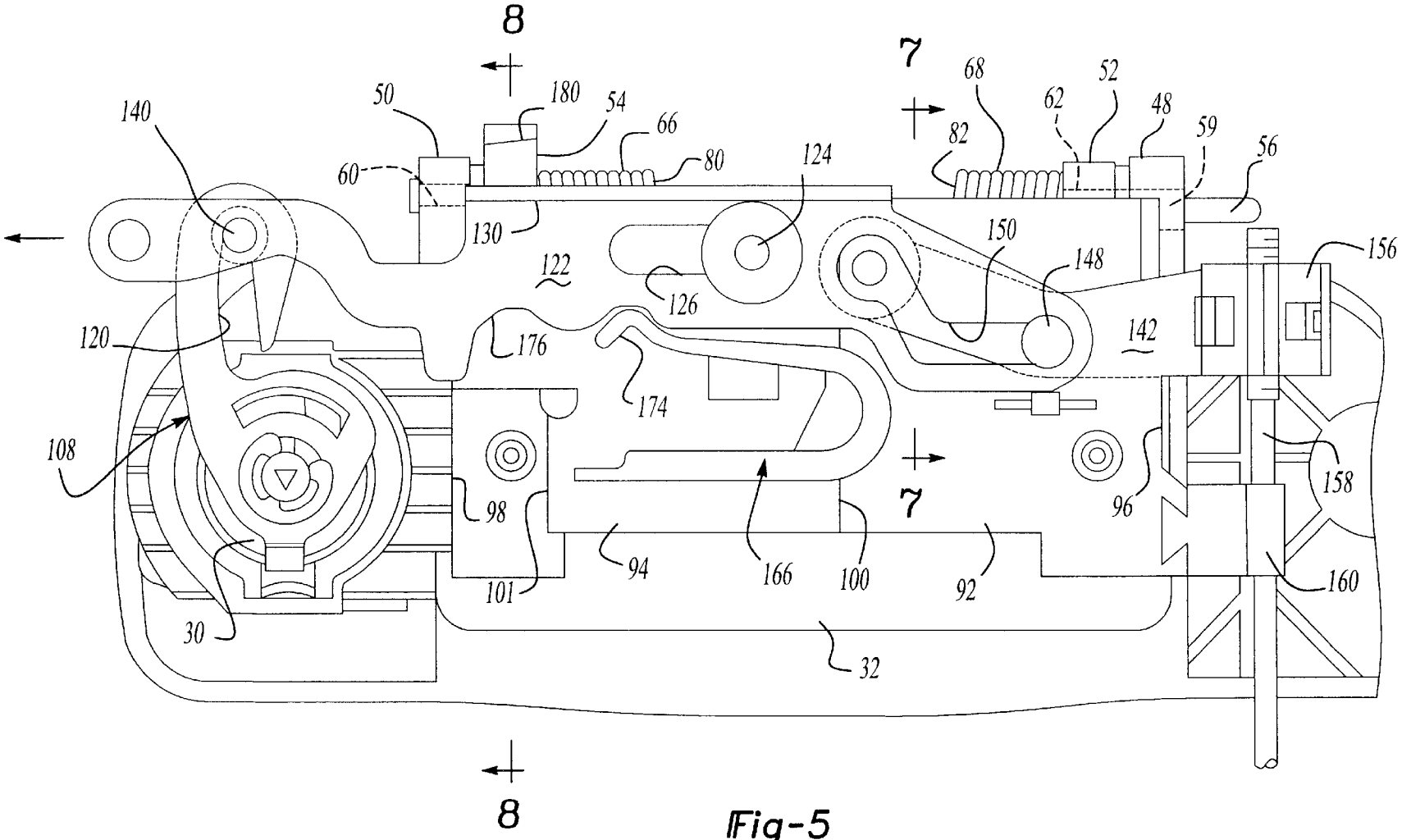

In operation, as illustrated in FIG. 5 once a key is inserted in the key cylinder 30 and rotated clockwise approximately a one-eighth turn, the lower body portion 110 of the key cylinder lever 108 is similarly rotated to thereby cause the pin 140 in the open-ended slot 120 to move laterally with the arm 116 and finger 118 and, hence, to move the lever 122 to its leftmost or unlocked mode position as permitted by the movement of the pin 124 in the slot 126 in the lever 122. This brings the bent-over lip 130 into position just below the actuator lug 180.

Returning to FIGS. 5–6, while the lever 122 is in the leftmost position just described above, when the handle 26 is pulled outwardly, the actuator lug 180 engages the bent-over lip 130, urging it and its associated lever 122 in a counterclockwise rotation about the pin 124 against the force of the upper leg 170 of the spring 166, which has its convex bend 174 seated in the recessed portion 178 on the bottom edge of the lever 122. The result of the counterclockwise movement of the lever 122 is to move the pin 140 downwardly in the open-ended slot 120 between the arm 116 and the finger 118 of the key cylinder lever 108, and the end 154 of the subordinate lever 142 upwardly causing the cable end fitting 162 to be lifted thereby raising the latch lever 164 (FIG. 2) unlatching the latch mechanism 164 (FIG. 2) for opening the liftgate 10. When the liftgate 10 is once again closed, and the handle 26 released, rotation of the key counterclockwise in the key cylinder 30 approximately a one-eighth turn moves the lever 122 to the right or locked mode via the corresponding action of the key cylinder lever 108, until the left end of the slot 126 engages the pin 124 to thereby render any lifting of the handle 26 ineffective, and retain the liftgate 10 in a locked condition. At this point, the convex bend 174 of the leaf spring 166 seats in the recessed portion 176 of lever 122. When leaf spring 166 is seated in either of recessed portions 176 or 178, a positive stop or detent position is thereby provided which prevents the main lever 122 from being accidentally jarred from one of the locked or unlocked mode to the other by any lateral load against the vehicle.

As an optional arrangement, a power actuator 190 (FIG. 3) may be mounted intermediate the outer and inner walls of the liftgate 10, and connected to the lever 122 via a connector 182. Specifically, a connector rod 184 is connected between an opening 186 formed in the end 138 and an end 188 of a power actuator 190 reciprocally mounted in the actuator 192. An electrical connection 194 mounted on the bottom surface of the actuator 192 is adapted to receive a connector 196 of a lead line 198 extending from power door locks (not shown). The power actuator 190 may be included in addition to key cylinder 30 to slidably move the lever 122 between the locked and the unlocked positions while the operator is inside the vehicle.

It can be appreciated from the above description that the subordinate lever 142 which is connected to the main lever 122 by slot 150 and pin 148, compensates for build variation in the handle and latch assembly. This is accomplished by allowing any variation to be taken up by the cable 158 which is installed with a loop in the cable 158 therein allowing excess cable to be available to compensate.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and the following claims. Thereof, the true scope of the invention should not be so limited since other modifications will become apparent to the skilled practitioner upon a study of the drawings, specification and the following claims.

What is claimed is:

1. A liftgate handle assembly for actuating a remotely mounted liftgate latch comprising:

a liftgate handle assembly including a housing having a handle pivotally mounted therein, a key cylinder rotatably mounted therein, a main lever slidably and pivotally mounted thereon, a subordinate lever mounted thereon and in pivotal communication with said main lever, said main lever being operably engageable by said handle and operably connected to said key cylinder;

a cable adapted to be connected between said subordinate lever and the liftgate latch, said main lever adapted to be reciprocally slidably actuated between a locked and an unlocked mode by rotation of said key cylinder and pivotally actuated in said unlocked mode by manual lifting of said handle to move said cable via said subordinate lever to thereby operate the liftgate latch.

2. The liftgate assembly according to claim 1 wherein said subordinate lever remains stationary during reciprocally slidable movement of said main lever.

3. The liftgate assembly according to claim 1 wherein said main lever and said subordinate lever are adapted to provide variations in build tolerances.

4. A liftgate handle assembly for actuating a remotely mounted liftgate latch comprising:

a liftgate handle assembly spaced apart from the liftgate latch, said handle assembly including a housing having a central recess formed therein, a handle flush mounted in the housing and adapted to be pivotally lifted outwardly therefrom, a key cylinder rotatably mounted in the housing adjacent said recess, a main lever slidably and pivotally mounted in the housing to the rear of said recess, a subordinate lever in pivotal communication with said main lever, said main lever being connected to said key cylinder to slide said main lever between locked and unlocked modes upon rotation of said key cylinder, a tab formed on said handle adapted to abut against and pivot said main lever when in the unlocked mode upon the manual pivotal lifting of said handle, said subordinate lever being in engaging communication with the liftgate latch, said main lever engaging said subordinate lever upon the manual pivotal lifting of said handle such that said subordinate lever engages the liftgate latch.

5. The liftgate assembly according to claim 4 wherein said assembly is adapted to provide for variation in build tolerances.

* * * * *